United States Patent [19]

Farge et al.

[11] Patent Number: 4,911,763

[45] Date of Patent: Mar. 27, 1990

[54] PROCESS FOR PRODUCING A LOW ALLOY WHITE CAST IRON

[75] Inventors: Jean C. Farge, Montreal; Michel Lefebvre, Pierrefonds; Robert Fortin, Mont-Joli, all of Canada

[73] Assignee: Norcast Corporation, Don Mills, Canada

[21] Appl. No.: 219,456

[22] Filed: Jul. 15, 1988

[51] Int. Cl.[4] ..... C21D 5/04

[52] U.S. Cl. ..... 148/3; 148/138; 148/141

[58] Field of Search ..... 148/138, 141, 3, 321

[56] References Cited

U.S. PATENT DOCUMENTS 2,899,346 8/1959 Péras ..... 148/138
4,619,713 10/1986 Suenaga et al. ..... 148/3

FOREIGN PATENT DOCUMENTS 1125056 6/1982 Canada .
29539 6/1981 European Pat. Off. ..... 148/3

*Primary Examiner*—Deborah Yee
*Attorney, Agent, or Firm*—Weingarten, Schurgin, Gagnebin & Hayes

[57] ABSTRACT

A process for producing a low alloy white cast iron is disclosed. The process comprises the steps of selecting one of a group of four alloying elements for a nickel, molybdenum/copper or modified low alloy iron; the four alloying groups consisting essentially, by weight percent of about:

Group 1: 2.5 to 4.0% carbon; 0.3 to 0.8% silicon; 0.3 to 0.8% manganese; 0.75 to 2.0% nickel; 0 to 0.75% chromium.

Group 2: 3.0 to 4.5% carbon; 0.3 to 0.8% silicon; 0.3 to 1.0% manganese; 0 to 0.8% molybdenum; and 0.3 to 1.0% copper.

Group 3: 3.0 to 4.5% carbon; 0.3 to 0.8% silicon; 0.3 to 1.0% manganese; and 0.3 to 0.8% copper;

the balance being iron except for incidental impurities commonly found in cast irons; melting the alloy; casting such alloy into moulds to produce the desired product; removing the product from the moulds while its surface temperature is above the transformation temperature of the alloy; and cooling it by quenching into a liquid medium containing water and an organic polymer at a sufficiently high rate to prevent the formation of pearlite but not so high as to generate cracks in the product.

14 Claims, No Drawings

PROCESS FOR PRODUCING A LOW ALLOY WHITE CAST IRON

FIELD OF THE INVENTION

This invention relates to a process for producing a low alloy white cast iron of high hardness, and more particularly to the production of a low alloy white cast iron for use as grinding media in the form of balls or truncated cones known as "slugs" in the ore processing industry.

BACKGROUND OF THE INVENTION

Materials used in grinding media applications where wear resistance is required include alloy steels, both cast and forged, and alloy white cast irons in the as-cast and heat treated condition. Alloy white cast irons are divided into two groups, one containing approximately 8 to 30% chromium and the other 0 to 4% chromium. High chromium white cast irons necessitate a special heat treatment above the transformation temperature to allow them to reach their full potential. This heat treatment combined with their high alloy content renders them uneconomical for many ore grinding applications. The other group of white cast irons is generally more economical although an amount of certain alloying elements is required to yield optimum properties.

It is widely recognized that low alloy white cast irons with a microstructure consisting of carbide and martensite offer high wear resistance in most ore grinding applications. Carbide is present in all white cast irons; martensite, on the other hand, is obtained through a combination of alloy content and processing conditions. If the conditions for martensite formation are not met, an undesirable phase known as pearlite will be produced upon cooling from the transformation temperature. Many alloying elements have been used over the years to avoid the formation of pearlite. These elements are used either alone or in the combined form, and they include nickel, chromium, molybdenum, copper, manganese and vanadium.

Because of its outstanding wear resistance, a nickel-chromium white cast iron known as Ni-Hard has been successfully used for over forty years to make grinding media. The microstructure of Ni-Hard consists essentially or carbide and martensite, and its hardness is 600 Brinell in the chill cast and stress relieved condition. Compositional ranges suggested for the manufacture of Ni-Hard grinding balls and slugs are about 3% carbon, 0.5% silicon, 0.5% manganese, 1.5–4% nickel and 1.0–2% chromium, the rest being iron.

A low alloy white cast iron having a hardness and a microstructure similar to those of Ni-hard was disclosed in Canadian Pat. No. 1,125,056 owned by the present assignee. The alloying elements were 2.5 to 4% carbon, 0.3 to 0.8% silicon, 0.3 to 1.0% manganese and 1.7 to 3.5% nickel.

The procedure followed for producing the above alloy was as follow: Iron and the above alloying elements were melted in a suitable furnace and cast into moulds. The cast product was shaken out of the moulds at a temperature above the transformation temperature and was either cooled with fine water sprays or subjected to forced air or still air cooling to cool it between approximately 1400° F. and 400° F. at a minimum of 2.5° F./sec. The above combination of alloy content and processing conditions produced an alloy with a microstructure consisting essentially of martensite and carbide with no pearlite. However, the minimum amount of nickel needed in the above process to avoid the formation of pearlite was 1.7%. In addition, the hardness of the cast product was not uniform throughout.

Although the above low alloy white cast iron was less expensive than Ni-Hard because it contained less nickel and no chronium, it was felt that more research was needed to further decrease the nickel content and thus, to develop a more cost-effective alloy for grinding media application. It was also desirable to develop a product having a more uniform hardness.

SUMMARY OF THE INVENTION

The process in accordance with the present invention comprises the steps of melting a first alloy embodiment consisting essentially of about 2.5 to 4% carbon, 0.3 to 0.8% silicon, 0.3 to 0.8 manganese, 0.75 to 2.0% nickel and 0 to 0.75% chromium, the balance being iron except for incidental impurities commonly found in cast irons.

A second group of alloy embodiments is based upon the inclusion of molybdenum with copper. Typical molybdenum/copper bearing low alloys consist essentially of carbon 2.5 to 4.0%; 0.3 to 0.8% silicon; manganese 0.3 to 0.8%; molybdenum 0.1 to 0.8% and copper 0.6 to 0.8%, the balance being iron except for incidental impurities commonly formed in cast iron.

The melting of the constituents of the two alloys is followed by casting such alloys into moulds, removing the cast products from the moulds while surface temperature is above the transformation temperature of the particular alloy white cast iron and cooling it by quenching into a liquid medium containing water and an organic polymer at a sufficiently high rate to prevent the formation of pearlite but not so high as to generate cracks in the product.

The above alloy combinations and processing conditions produce microstructures consisting essentially of martensite and carbide with a uniform hardness in excess of 600 Brinell.

The cast products are then subjected to a heat treatment of 4 to 8 hours at 400°–600° F. to transform any retained austenite into martensite and to relieve casting stresses.

In the making of grinding media such as slugs, the size of slugs varies generally but is preferably in the range of approximately 1 to 3 in. The relative alloy contents, particularly of nickel and molybdenum/copper of the two respective alloy groups, and the cooling rates are adjusted as a function of slug size: the lower alloy content and high cooling rate are used with small slugs and higher alloy content and low cooling rates are used with large slugs. Good results are obtained with the following combinations:

For 1½ in. and smaller slugs: in the case of nickel alloys 0.75 to 1.5% nickel and 0 to 0.5% chromium and cooling rates in the range of 7.5°–25° F. per second;

In the case of molybdenum alloys 0.2 to 0.3% molybdenum, copper and the same high cooling rates;

For 2, 2½ and 3 in. slugs: 1.25 to 2% nickel and 0.25 to 0.75% chromium and 0.5 to 0.6% molybdenum with 0.6 to 0.8% copper the cooling rates are in the range of 2.5°–7.5° F. per second.

In the case of both groups of alloys the volume of polymer used in the cooling medium is in the range of 5–30% and is adjusted so as to provide a controlled rate of cooling which, for a given slug size and alloy content, will prevent the formation of pearlite and, at the same time will not generate cracks in the final product. For best results, the temperature of the liquid medium is kept in the range of 90°–130° F.

Before arriving at the preferred embodiments a test program on alloys containing 0.5 to 3.0% nickel and 0 to 2% chromium was carried out on a pilot scale in the case of the nickel alloy. A similar test program on the molybdenum/copper was carried out, on alloys containing 0 to 2.0% molybdenum and 0.3% to 2% copper.

Each alloy was based on a cast iron mixture containing approximately 3% carbon, 0.6% silicon and 0.6% manganese, the remainder being iron. Other variables investigaged in the test program were the concentration in the range of 2.5–30% by volume of the organic polymer and the temperature, in the range of 1200°–1800° F., from which the grinding slugs are quenched into the liquid medium.

An example of the procedure followed in the test programs will now be disclosed. Metal charges consisting of pig iron, steel scrap, ferro-manganese, ferro-silicon, nickel and ferro-chrome were melted in a coreless induction furnace and poured into cast iron moulds containing either 1½ or 2½ inch slug cavities. The slugs were shaken out of the moulds at 1500° F. and were quenched immediately into water containing 2.5–10% and 10–30% Aqua-Quench* organic polymer for the 1½ and 2½ in. slugs respectively.

(* TM)

The organic polymer, known as Aqua-Quench 200 is a soluble synthetic quenchant for hardening steel of high hardenability.

The organic polymer is a concentrated aqueous solution of alkali polyacrylate with complete solubility in water; its aqueous solutions do not split when heated.

The corresponding cooling rates were established using thermocouples inserted into the slug cavities while the metal was still molten, and connected to a recording instrument. The as-cast slugs were then subject to a heat treatment of 4 hours at 500° F. None of the slugs were cracked and their microstructure consisted essentially of martensite and carbide. Table 1 shows the relationship between alloy content, cooling rate and hardness for the heat treated slugs.

TABLE 1

EFFECT OF ALLOY CONTENT AND COOLING RATE ON THE HARDNESS OF 1½ AND 2½ IN. LOW ALLOY NICKEL GRINDING SLUGS

| Slug Size in. | Alloy Content weight % Ni | Cr | Cooling Rate °F./s | Average Brinell Hardness |
|---|---|---|---|---|
| | 0.75 | 0.5 | 19.3 | 635 |
| | 1.0 | 0.5 | 19.3 | 615 |
| 1½ | 1.5 | 0 | 9.6 | 635 |
| | 1.5 | 0.25 | 20.8 | 680 |
| | 1.5 | 0.5 | 7.5 | 690 |
| | 1.5 | 0.5 | 4.7 | 615 |
| 2½ | 1.5 | 0.75 | 3.7 | 650 |
| | 2.0 | 0.5 | 2.4 | 660 |

In the case of the molybdenum/copper low alloy slugs similar cooling rates and hardnesses apply.

Full scale foundry tests have shown that the new white cast iron of the present invention may be melted and cast using standard foundry practice and casting methods. The melting equipment used so far in these full scale tests has been a channel-type induction furnace. However, other melting equipment such as cupolas or various types of electric furnaces could also be used. Test to date were run on 1⅛, 1½, 2, 2½ and 3 inch grinding slugs cast in permanent moulds. The composition of the slugs is given in Table II.

TABLE II-A

COMPOSITION IN WEIGHT PERCENT OF GRINDING SLUGS PRODUCED DURING FULL SCALE FOUNDRY TESTS

| Slug Size in. | Carbon | Silicon | Manganese | Nickel | Chromium |
|---|---|---|---|---|---|
| 1⅛ | 3.6 | 0.55 | 0.6 | 0.9 | 0.4 |
| 1½ | 3.4 | 0.55 | 0.6 | 0.9 | 0.4 |
| 2 | 3.2 | 0.55 | 0.6 | 1.4 | 0.4 |
| 2½ | 3.2 | 0.55 | 0.6 | 1.7 | 0.4 |
| 3 | 3.2 | 0.55 | 0.6 | 1.7 | 0.4 |

TABLE II-B

COMPOSITION IN WEIGHT PERCENT OF GRINDING SLUGS PRODUCED DURING FULL SCALE FOUNDRY TEST

| Slug Size in. | Carbon | Silicon | Manganese | Molybdenum | Copper |
|---|---|---|---|---|---|
| 1⅛ | 3.6–3.9 | 0.5–0.7 | 0.5–0.7 | 0.20–0.30 | 0.60–0.80 |
| 1½ | 3.3–3.6 | 0.5–0.7 | 0.5–0.7 | 0.20–0.3 | 0.60–0.80 |
| 2 | 3.1–3.4 | 0.5–0.7 | 0.5–0.7 | 0.4–0.5 | 0.6–0.8 |
| 2½ | 3.1–3.4 | 0.5–0.7 | 0.5–0.7 | 0.5–0.6 | 0.6–0.8 |

The slugs were quenched from a temperature in the range of 1400°–1600° F. into water containing 8% by volume of Aqua-Quench 200 for the 1⅛ and 1½ inch slugs and 21, 24 and 27% by volume of Aqua-Quench 200 for the 2, 2½ and 3 inch slugs respectively. The slugs were removed from the quenching solutions at a temperature in the range of 100°–300° F. and heat treated for 4 hours at 500° F. The resulting hardness of the slugs was in excess of 600 Brinell and their microstructure consisted essentially of martensite and carbide.

In the case of the molybdenum/copper low alloy it has been found that use of Ni-Hard scrap can give nickel content in the range 0.25 to 0.45 percent, while reducing the copper requirement to as low as 0.3%. These minor changes tend to boost the Brinell hardness of the slugs thus obtained to the top of the range.

The introduction of correspondingly low quantities of chromium in the range 0.25 to 0.45 percent as a modifying alloying element are not detrimental to the low alloy cast iron grinding slugs obtained, and generally is beneficial in that it generally enables a reduction in the percentage of the other alloying metals, while tending to increase the Brinell hardness of the slugs produced, within the stated range.

Although the invention has been disclosed with reference to a preferred embodiment, it is to be understood that it is not limited to such embodiment but by the scope of the claims only.

What is claimed is:

1. A process for producing a low alloy white cast iron comprising:

(a) melting an alloy consisting essentially of about 2.5 to 4.0% carbon, 0.3 to 0.8% silicon, 0.3 to 0.8% manganese, 0.75 to 1.5% nickel and 0 to 0.75% chromium; the balance of the alloy being iron except for incidental impurities commonly found in cast irons;

(b) casting said alloy into moulds to produce the desired product;

(c) removing the product from the moulds while its surface temperature is above the transformation temperature of the alloy; and (d) cooling the product by quenching into a liquid medium containing water and an organic polymer, said cooling being carried out at a sufficiently high rate to prevent the formation of pearlite but not so high as to generate cracks in the product, to enable subsequent transformation substantially totally to martensite and carbide, with a consequent hardness in excess of 600 Brinell.

2. A process as defined in claim 1, further comprising the step of heat treating the product at a temperature of 400°–600° F. for a time period of 4 to 8 hours.

3. A process as defined in claim 2, wherein the product is heat treated at a temperature of about 500° F. for about 4 hours.

4. A process as defined in claim 1, wherein the products are grinding slugs in the size of 1 to 3 in, and wherein the cooling rate is in the range of 2.5° to 25° F./sec.

5. A process as defined in claim 4, wherein the alloying content and cooling rates are adjusted as a function of slug size, lower alloy content and high cooling rates being used with small slugs, and higher alloy content and low cooling rates with large slugs.

6. A process as defined in claim 4, wherein the volume of said organic polymer used in the liquid medium is in the range of 5 to 30%, said volume value increasing with increase in slug size.

7. A process as defined in claim 4, wherein the temperature of the liquid medium is kept in the range of 90° to 130° F.

8. A process for producing a low alloy white cast iron comprising:

(a) melting an alloy selected from one of three alloys, the first alloy consisting essentially of about 3.0 to 4.5% carbon; 0.3 to 0.8% silicon; 0.3 to 1.0% manganese; 0 to 0.8% molybdenum; and 0.3 to 1.0% copper; the second alloy consisting essentially of about 3.0 to 4.5% carbon; 0.3 to 0.8% silicon; 0.3 to 1.0% manganese; 0.25–0.45% nickel; 0 to 0.8% molybdenum; and 0.3 to 0.8% copper; the third alloy consisting essentially of about 3.0 to 4.5% carbon; 0.3 to 0.8% silicon; 0.3 to 1.0% manganese; 0.25 to 0.45% chromium; 0 to 0.8% molybdenum; and 0.3 to 0.8% copper, the balance of the three alloys being iron except for incidental impurities commonly found in cast irons;

(b) casting said alloy into moulds to produce the desired product;

(c) removing the product from the moulds while its surface temperature is above the transformation temperature of the alloy; and (d) cooling the product by quenching into a liquid medium containing water and an organic polymer, said cooling being carried out at a sufficiently high rate to prevent the formation of pearlite but not so high as to generate cracks in the product, to enable subsequent transformation substantially totally to martensite and carbide, with a consequent hardness in excess of 600 Brinell.

9. A process as defined in claim 8, further comprising the step of heat treating the product at a temperature of 400°–600° F. for a time period of 4 to 8 hours.

10. A process as defined in claim 9, wherein the product is heat treated at a temperature of about 500° F. for about 4 hours.

11. A process as defined in claim 8, wherein the products are grinding slugs in the size of 1 to 3 in, and wherein the cooling rate is in the range of 2.5° to 25° F./sec.

12. A process as defined in claim 11, wherein the alloying content and cooling rates are adjusted as a function of slug size, lower alloy content and high cooling rates being used with small slugs, and higher alloy content and low cooling rates with large slugs.

13. A process as defined in claim 11, wherein the volume of said organic polymer used in the liquid medium is in the range of 5 to 30%, said volume value increasing with increase in slug size.

14. A process as defined in claim 11, wherein the temperature of the liquid medium is kept in the range of 90° to 130° F.

* * * * *